United States Patent [19]

Santiago et al.

[11] Patent Number: 5,001,899

[45] Date of Patent: Mar. 26, 1991

[54] PROCESS AND APPARATUS FOR THE CLEANING OF A SOOT FILTER

[75] Inventors: Enrique Santiago, Diedorf; Peter Kugland, Friedberg; Alois Ullmer, Müchen, Fed. Rep. of Germany

[73] Assignee: Zeuna-Starker GmbH & Co. KG, Fed. Rep. of Germany

[21] Appl. No.: 209,227

[22] Filed: Jun. 20, 1988

[30] Foreign Application Priority Data

Jun. 24, 1987 [DE] Fed. Rep. of Germany ..... 3720829

[51] Int. Cl.[5] ..... F01N 3/02

[52] U.S. Cl. ..... 60/274; 60/288; 60/303

[58] Field of Search ..... 60/303, 288, 286, 274

[56] References Cited

U.S. PATENT DOCUMENTS 4,538,413 9/1985 Shinzawa ..... 60/303
4,541,239 9/1985 Tokura ..... 60/303
4,651,524 3/1987 Brighton ..... 60/274

FOREIGN PATENT DOCUMENTS 158311 9/1984 Japan ..... 60/303

*Primary Examiner*—Douglas Hart
*Attorney, Agent, or Firm*—Brumbaugh, Graves, Donohue & Raymond

[57] ABSTRACT

A method and apparatus for cleaning of a soot filter in the exhaust line of a diesel engine with a combustion chamber placed in front of the soot filter where a fuel nozzle and an adapted electrical ignition mechanism is built in thereby enabling an after burning of the exhaust without secondary air. The exhaust in the combustion-chamber is mixed with the fuel, which is injected through the fuel nozzle, and ignited by an ignition-device with the existing portion of the unburned oxygen. The hot exhaust effects the burn down of the accumulated soot in the soot filter.

16 Claims, 4 Drawing Sheets

PROCESS AND APPARATUS FOR THE CLEANING OF A SOOT FILTER

DESCRIPTION

This invention relates to a procedure of cleaning of a soot filter in the exhaust system of a diesel engine under load and for all engine speeds, as well as an appropriate technique of this procedure with a functionally adapted combustion chamber in front of the soot filter, where a fuel nozzle and a specific ignition mechanism is built in.

Such a procedure is known from the German Publication 321994. With this the combustion works with secondary air supply, which is heated by a cylinder surrounding the combustion chamber before it actually arrives at the combustion chamber. There, the mixture of secondary air and the injected fuel is ignited by a glow plug. The hot combustion gas will be used for regeneration of an after-coupled soot filter.

The invention in question has the objective to achieve the burning up the soot in a soot filter for varying engine operating conditions in an effective yet constructively simple way.

According to the invention in question, this objective will be fulfilled by a method according to claim 1 and an apparatus according to claim 2, where the conducting of secondary air into the combustion chamber can be totally eliminated. Due to the fact that through the combustion chamber only a partial exhaust stream, comprised of less than about 25% of the total exhaust flow, is led therein and is, by means of an igniting-mechanism, ignited, the igniting conditions are easier to control. With proper dosage of the partial exhaust flow, it is possible to accomplish a consistent burning of the $CO_2$-portions that are still remaining in the exhaust flow, from 7 to 15% of the total exhaust flow. The engine exhaust, led into the combustion chamber, the temperature in which is a maximum of 400° C., is intensely heated by the after burning in the combustion-chamber. It is possible, by means of the heated partial exhaust flow, which will be mixed again with the main exhaust main stream ahead of the soot filter, to raise the exhaust temperature of the total exhaust stream to about 700° C. This temperature exceeds the ignition temperature of the burning soot in the soot filter. It is important for this increase in temperature, that at first only a portion of the exhaust will get ignited and burned with the injected fuel in the combustion chamber, and that the evaporated fuel be burned only partially, so that the mixing of the hot burning gas with other exhaust portions inside and or immediately following the combustion chamber can develop another afterburning of the added exhaust portions, with the result that the temperature of the total exhaust flow in front of the soot filter is noticeably higher than the temperature of the initial mixture.

It is possible to accomplish an extremely constant igniting and burning condition, because of the planned connection of the combustion-chamber with the ignition-chamber which is saturated with a partial exhaust flow. In addition, a certain method of procedure is preferred wherein the ignition chamber is located within the combustion chamber and wherein the ignition chamber is saturated by a first partial exhaust flow from a space created between the wall of the combustion chamber and the ignition chamber, and a second partial exhaust flow, and that both partial exhaust streams are mixed within the combustion chamber beyond the ignition chamber. Through this, as demonstrated above, a burning of the added partial exhaust flow takes place, thus, with this method only the first partial exhaust flow will be ignited in the ignition chamber, while the second partial exhaust flow exchanges heat with the wall of the ignition chamber which means it takes in limited heat but at the same time isolates the ignition chamber from the cooler surroundings. The portion of the first partial exhaust flow of the total exhaust flow preferably contains between 2% and 5%, and that of the second partial exhaust flow 15% to 20%. The mixing of both partial exhaust flows occurs within the combustion chamber, where provision is made for the second partial exhaust flow to rotate through the spiral shaped baffles between the ignition chamber and the wall of the combustion chamber. As a result an especially close mixing of both partial exhaust flows takes place, also creating the burning of the added partial exhaust flow. After the partial exhaust flows, expelled from the combustion-chamber, intermingle with the main exhaust flow, there results an afterburning with the remainder of the $CO_2$ contained in the main exhaust flow.

Within the boundaries of the invention it is possible to build the combustion chamber either into a bypass pipe of the exhaust system or to have it surrounded by the exhaust pipe in such a way that the main exhaust flow is channeled by an outer annular chamber between the exhaust line and the wall of the combustion chamber. This method proves especially efficient in conserving energy and space.

A suitable design of the procedure is that the combustion chamber is positioned just about concentric into the exhaust pipe and is connected upwards to a chamber, where the wall curves against the flow of the exhaust and has an opening in the center. For the exact dosage of both partial exhaust flows another method can be provided by abutting the chamber to a diaphragm with a first opening for the dosage of the first partial exhaust flow and pointing to a second opening located radially outside the ignition chamber for the proper dosage of the second exhaust flow.

It is preferable for the ignition chamber to be a form of a Venturi nozzle, where the mouth of the fuel nozzle is placed just about in the most narrow part of the ignition chamber or close behind it.

Another suggestion for the procedure of the invention is that the ignition mechanism is surrounded by two ignition electrodes, which are guided through the exhaust pipe, the wall of the combustion chamber and the wall of the ignition chamber, so that their electrodes face each other close to the mouth of the fuel nozzle.

To achieve an especially balanced combustion process under safe ignition conditions in changing load conditions over the total range of revolutions of the diesel engine, it could be of further advantage that the end portion of the combustion chamber is void of any build-ins, and where the first and second partial exhaust flows mix, with perforations provided for the onward flowing of the portions of the main exhaust.

Here a small first partial exhaust enables the preservation of stable igniting conditions in conjunction with continued complete incineration of the exhausts with the remaining $CO_2$ of the successively introduced portions of the partial exhaust flow. It does not matter, within the boundaries of the invention, what kind of a soot filter is used, for example the standard ceramic filter come into consideration as well as the so called ceramic swaddle filter, where steel pipes with punched holes are wrapped with a ceramic fiber.

Furthermore, within this invented method, an exhaust turbine could be in series. The fuel used for the function of the fuel nozzle can be matched according to the preference of the motor fuel, which has been given an advantageous additive to help the incineration process of the burning of the soot.

The supply of fuel into the fuel nozzle can be regulated according to the engine load; from an operating point of view, the hotter the engine exhaust in the regeneration area, the less fuel injected into the combustion chamber is needed.

The kind of ignition electrodes to be used are the ones which are used in heating systems, for example, and are readily available on the market.

The invention will be explained below with reference to the drawings.

Figure 1:
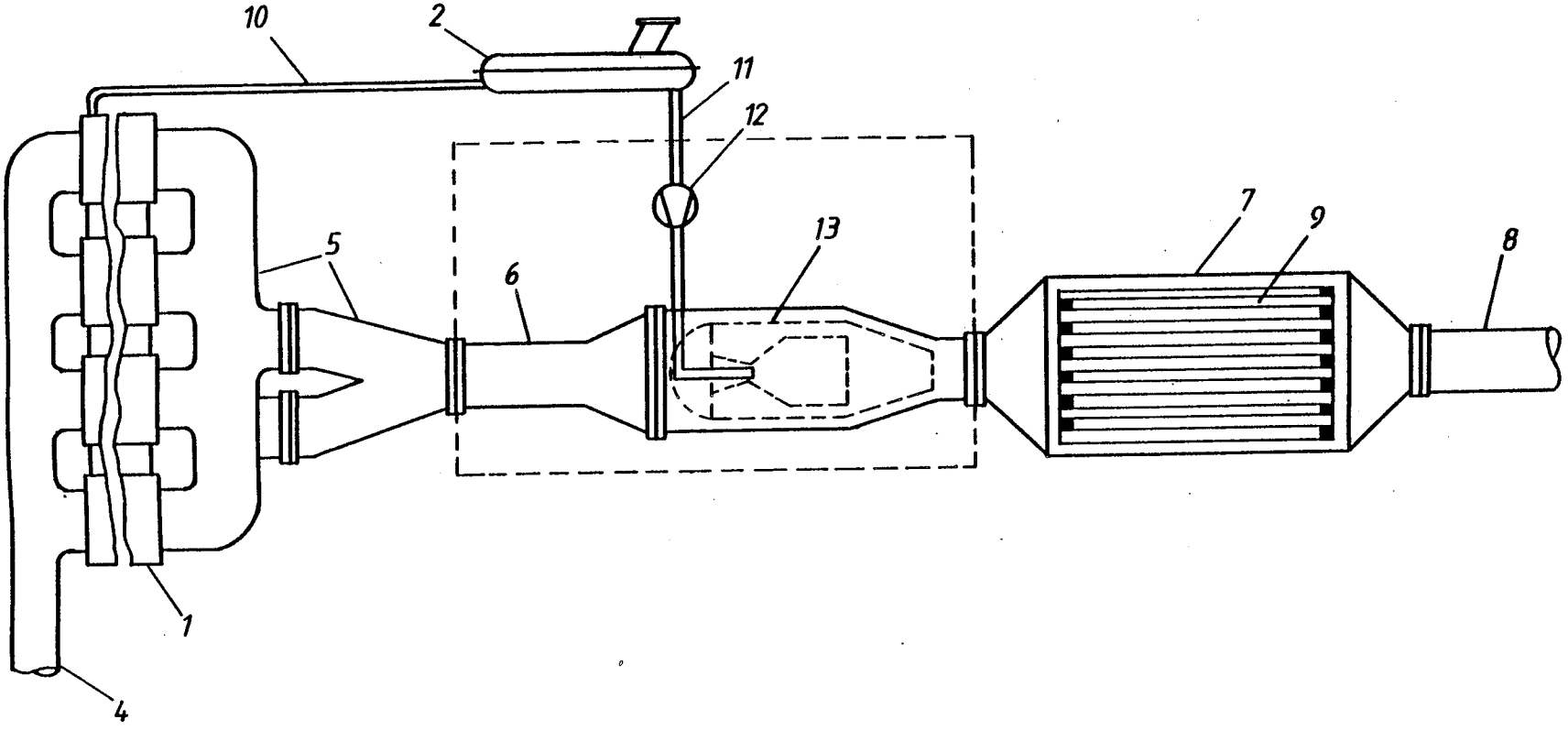
FIG. 1 is a schematic view of the invented method in an exhaust system, located between the engine and soot filter.

According to FIG. 1 a diesel engine (1) above a fuel tank (2) is provided with fuel. The suctioned air runs into the diesel engine (1) in an air suction line (4). An exhaust pipe (6) is connected to the exhaust manifold (5) of the diesel engine (1), which is connected with an exhaust pipe via a soot filter (7).

The soot filter (7) contains a ceramic insert (9) with channels running in the direction of the flow, where the unburned soot is collected. The fuel tank (2) is connected to the diesel engine (1) by a fuel line (10); another fuel line (11) which has a built in booster-pump (12) is then connected with a combustion chamber (13), where the exhaust line (6) is placed between the exhaust manifold (5) and the soot filter (7). For the afterburning, the fuel of the fuel line (11) is injected with partial exhaust, led through the combustion chamber (13) which is described in more detail in FIGS. 3 and 4.

Figure 2:
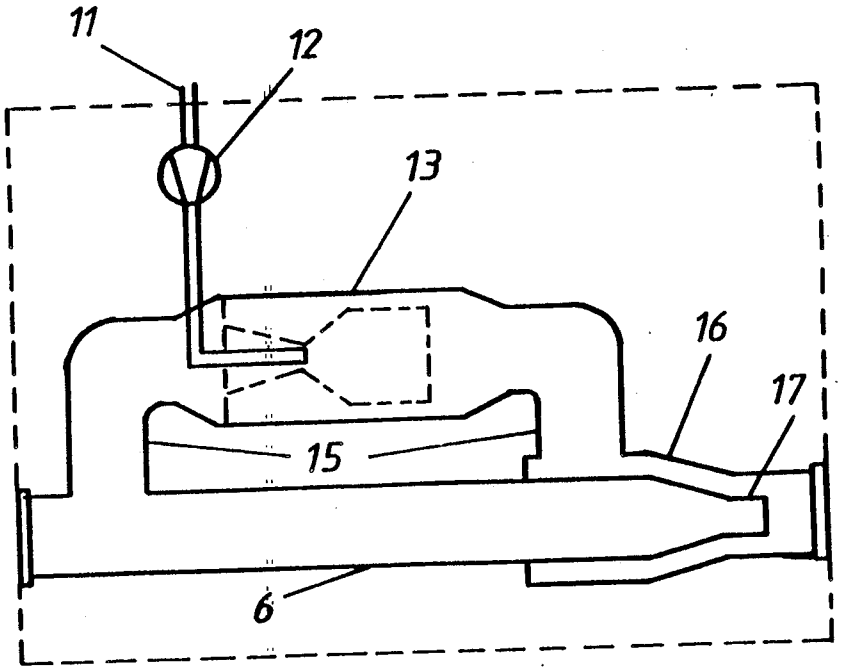
FIG. 2 is an excerpt A of FIG. 1 with an alternative arrangement of the combustion chamber.

FIG. 2 shows section A of FIG. 1 with an alternative position of the combustion chamber (13) which is built into a bypass line (15) branched off the exhaust line. The bypass line (15) is connected upwards with the exhaust line (6) by a scoop encasing the exhaust line (6), which is divided within the boundaries of the scoop, where the upstream position of the exhaust line ends in a narrowing (17).

Figure 3:
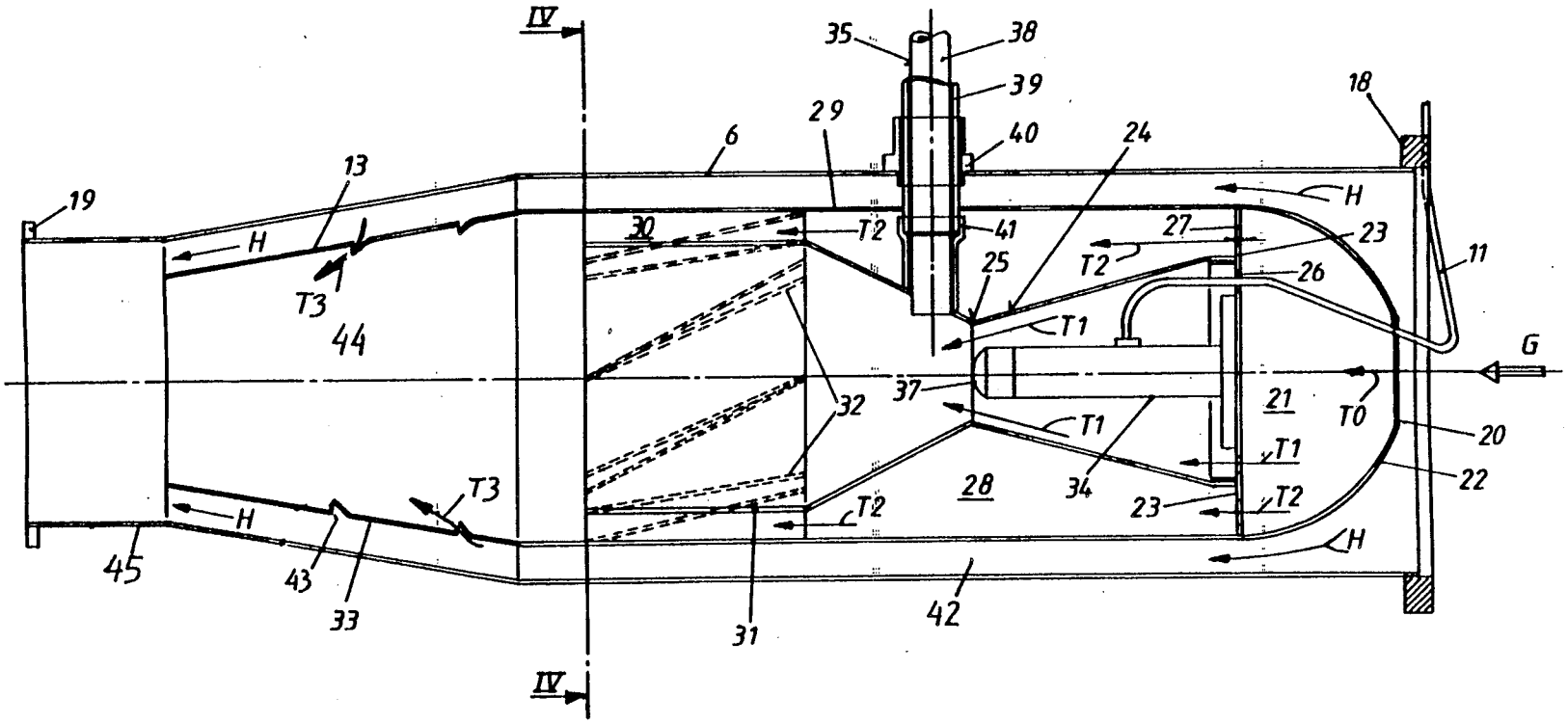
FIG. 3 is a lengthwise section through a combustion chamber, which is located inside the exhaust pipe.

FIG. 3 shows an axial section through the combustion chamber, which is located within the exhaust line (6). With its right end, the exhaust line (6) is connected through a flange with a section on the engine side (not shown) of the exhaust line (6). With the flange (19), provided on the left side, is the exhaust line, which is narrowing toward the left end, flanged with the casing of the soot filter (7). Through the combustion chamber (13), positioned inside the exhaust flow (6), the total exhaust stream running out of the exhaust line (6) according to arrow G, divided into one of the combustion chamber (13), that formed an outer annular chamber (42) formed between the combustion chamber (13) and the exhaust line (6) surrounding the total exhaust flow according to arrow (H) and a partial exhaust flow (10), which runs into one of the combustion chamber (13) through an opening of the chamber (21) connected in series. The chamber has a wall with an opening curved against the flow which is surrounded by the total exhaust flow (H). This wall (22) is connected to the side of the combustion chamber by a chamber (21) with an upstream diaphragm which has different openings. The other side of the diaphragm (23) connects to an ignition chamber (24) which has a narrowing like a Venturi nozzle.

Figure 4:
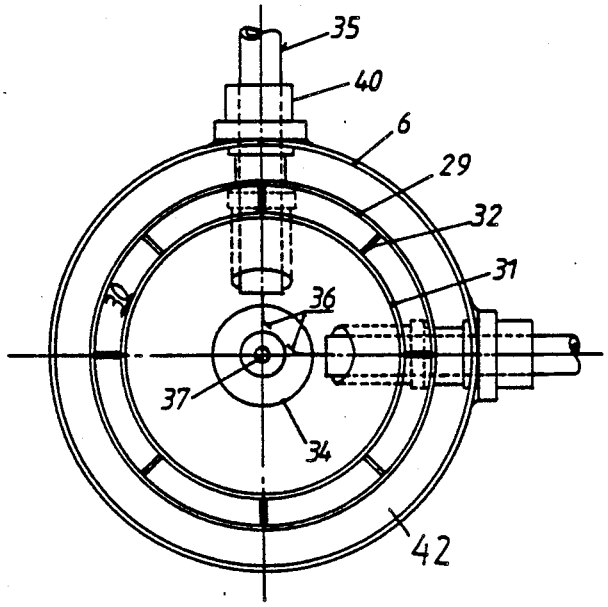
FIG. 4 is an axial view taken at IV—IV in FIG. 3.

First openings (26) in the diaphragm (23) join into the inside of the ignition chamber (24) through which a first partial exhaust flow according to arrow (T1) runs. A second partial exhaust flow according to arrow (T2) reaches a chamber (28) through a second opening (27) in the diaphragm between ignition chamber (24) and a cylindrical wall (29) portion in the combustion chamber (13). The chamber (28) as well as the inside of the ignition chamber (24) are open at their discharge end so that both exhaust streams (T1, T2) mix behind the ignition chamber (24) inside the combustion chamber (13). To achieve the best possible mixing, an annular chamber (30) between a cylindrical midsection of the ignition chamber (24) and the surrounding cylindrical wall section (29) of the combustion chamber (13) is provided with a baffle in form of a spiral, which then causes a spiralling of the second exhaust flow (T2). The end section (33) of the combustion chamber (13) which narrows into the direction of the exhaust stream joined at the ignition chamber (24) which is free of all builtins; the partial exhaust flows (T1 and T2) mix together, after leaving the downstream open combustion chamber (13). This exhaust mixture, whose temperature measures about 700° C, teaches the soot filter and ensures the burning of the soot. The end section (33) of the combustion chamber (13) shows perforations (43), which cause an admixture of portions (T3) of the main exhaust flow (H) still within the combustion chamber (13). The rise in temperature through the afterburning flow depends on the first partial exhaust flow (T1) whose contents of unburned oxygen are ignited behind the fuel nozzle (34). Two ignition electrodes (35) which pass through the exhaust pipe (6) as well as the combustion chamber (13), and finally also through the wall of the ignition chamber face each other in a 90° angle and serve as an ignition device. The electrodes (36) as displayed in FIG. 4 are positioned immediately next to the aperture (37) of the fuel nozzle (34) so that their ends face each other. The ignition electrodes (35) each have a porcelain body (38) which are surrounded by a steel pipe for heat protection. By means of a casing (40) attached to the steel pipe, the ignition electrodes (35) are anchored in the wall of the exhaust line (6); the inner end of the porcelain body (38) is held by a socket which is connected to the ignition chamber (24).

The fuel pipe (11) extends into the inside of the ignition chamber (24) through an opening (20) of the wall (22) of the chamber (21) and through a first opening (26) of the diaphragm (23) where it is connected with a fuel nozzle (34). Comparing the influx sections of the partial exhaust flow (T1) and (T2) as well as the main exhaust flow (H) to the height of the diaphragm (23) the proportion of the surfaces relate in a concrete example: FT1:FT2:FH=2:11:50. The cross section of the opening (20) in the chamber (21) equals approximately the sum of the first opening (26) and the second opening (27) in the diaphragm (23). An entry temperature of 400° C. of the exhaust into the combustion chamber, after ignition in the ignition chamber (24) results in a temperature of about 1100° to 1200° C. of the first partial exhaust flow (T1). The mixing of the first partial exhaust flow (T1) with the second partial exhaust flow (T2) will now result in the burning of the gas mixture in the incineration portion (44) of the combustion chamber (13). Following this an afterburning develops of both partial exhaust flows (T1, T2) through the admixture to the main exhaust flow (H). This addition develops partially because of the perforations (43) in the incinerating chamber (44) mainly behind the combustion chamber (13) within the section (45) of the exhaust pipe (6) leading to the soot filter (7). As a result an exhaust mixture temperature of about 700° C. is achieved, where the temperature is regulated accordingly through the injected fuel portion. This temperature is sufficient for the regeneration of the soot filter (7) through burning of the soot that is collected there.

What I claim is:

1. Apparatus for the cleansing of a soot filter inside the main exhaust line of a diesel engine under load, said apparatus comprising a soot filter, a combustion chamber placed in front of the soot filter, a fuel nozzle and an electrical ignition apparatus built into the combustion chamber, means for leading at least a portion of the main exhaust flow from the diesel engine into said combustion chamber to be mixed with fuel from the fuel nozzle and ignited by the ignition apparatus, means for leading hot gas from said chamber, means for leading said hot gas to said soot filter so as to incinerate soot in said filter, means located in front of the combustion chamber for dividing from the main exhaust flow at least first partial exhaust flow, means for leading said partial exhaust flow to said combustion chamber, means for combining said hot gas from said chamber with the remaining main exhaust flow in front of said soot filter and wherein the ignition apparatus includes an ignition chamber, two ignition electrodes which are channeled through the exhaust line, a combustion chamber wall, and a wall of the ignition chamber, so that their electrodes face each other close to an aperture of the fuel nozzle and further wherein said means for dividing is adapted to cause said partial exhaust flow to amount to less than 25% of the entire exhaust flow.

2. Apparatus according to claim 1, wherein the combustion chamber includes an ignition chamber adapted to be flooded by a partial exhaust flow.

3. Apparatus according to claim 2, wherein the ignition chamber has an outside wall and is placed within the combustion chamber, means for flooding the ignition chamber by a first portion of said partial exhaust flow, and including between the combustion chamber wall and the ignition chamber a space adapted to be flooded by a second portion of said partial exhaust flow and means for mixing said first and second portions of said partial exhaust flow together inside the combustion chamber beyond the ignition chamber.

4. Apparatus according to claim 3, including an annular chamber located between the ignition chamber and the combustion chamber, and spiral shaped baffle means inside said annular chamber adapted to cause rotation in said second portion of said partial exhaust flow.

5. Apparatus according to claim 1, wherein the combustion chamber is built into a bypass line branched off the main exhaust line.

6. Apparatus according to claim 3, wherein the first portion of the partial exhaust flow amounts to 2 to 5% of the entire exhaust flow.

7. Apparatus according to claim 3, wherein the second portion of the partial exhaust flow amounts to 15 to 20% of the entire exhaust flow.

8. Apparatus according to claim 2, wherein the ignition chamber narrows in form of a Venturi nozzle and the aperture of the fuel nozzle is located at about the narrow section of the ignition chamber or slightly behind it.

9. Apparatus according to claim 3, wherein the combustion chamber where the first and second portion of the partial exhaust flow intermix, said end section being free of all builtins and being provided with perforations for the influx of the partial flows.

10. Apparatus for the cleaning of a soot filter inside the main exhaust line of a diesel engine under load, said apparatus comprising a soot filter, a combustion chamber placed in front of the soot filter, a fuel nozzle and an electrical ignition apparatus built into the combustion chamber, means for leading at least a portion of the main exhaust flow from the diesel engine into said combustion chamber to be mixed with fuel from the fuel nozzle and ignited by the ignition apparatus, means for leading hot gas from said chamber, means for leading said hot gas to said soot filter so as to incinerate soot in said filter, means located in front of the combustion chamber for dividing from the main exhaust flow at least a first partial exhaust flow, means for leading said partial exhaust flow to said combustion chamber, means for combining said hot has from said chamber with the remaining main exhaust flow in front of said soot filter, and wherein the ignition apparatus includes an ignition chamber, two ignition electrodes which are channeled through the exhaust line, a combustion chamber wall, and a wall of the ignition chamber, so that their electrodes face each other close to an aperture of the fuel nozzle, and further wherein the combustion chamber is encased by the exhaust line in such a form that the main exhaust stream will be directed through an outer annular chamber between the exhaust line and the wall of the combustion chamber and wherein the combustion chamber is placed substantially concentrically within the exhaust line and is connected upstream to a chamber, whose wall is curved against the direction of the exhaust and has a center opening.

11. Apparatus according to claim 10, wherein the chamber borders on a diaphragm having a first opening is for the measuring of the first portion of the partial exhaust flow and radially outside the ignition chamber a second opening adapted for the measuring of the second portion of the partial exhaust flow.

12. Apparatus for the cleaning of a soot filter inside the main exhaust line of a diesel engine under load, said apparatus comprising a soot filter, a combustion chamber placed in front of the soot filter, a fuel nozzle and an electrical ignition apparatus built into the combustion chamber, means for leading at least a portion of the main exhaust flow from the diesel engine into said combustion chamber to be mixed with fuel from the fuel nozzle and ignited by the ignition apparatus, means for leading hot gas from said chamber, means for leading said hot gas to said soot filter so as to incinerate soot in said filter, means located in front of the combustion chamber for dividing from the main exhaust flow at least a first partial exhaust flow, means for leading said partial exhaust flow to said combustion chamber, means for combining said hot gas from said chamber with the remaining main exhaust flow in front of said soot filter and means for leading a remaining portion of the divided main exhaust flow separate from the portion to be mixed with the fuel from the fuel nozzle and ignited in the ignition apparatus to a point in front of the soot filter.

13. Method of cleaning a soot filter in the exhaust line of a diesel engine under load and for all engine speeds, including the steps of:

(a) branching a partial exhaust flow off the total exhaust flow;

(b) leading the partial exhaust flow to a combustion chamber having a built-in ignition mechanism and a fuel nozzle;

(c) injecting engine fuel into the combustion chamber through said fuel nozzle in an over stoichiometric amount, said amount being controlled depending on the respective point of engine operation in a manner that the amount of the fuel injected into the combustion chamber is reduced on increasing temperature of the engine exhaust gas during the regeneration phase;

(d) igniting the partial exhaust flow or a branched off first partial exhaust flow from the partial exhaust flow in the combustion chamber together with the injected fuel thereby causing hot gas to be developed comprising evaporated unburned fuel; and (e) combining the hot gas from the combustion chamber with a main exhaust flow channeled around the combustion chamber at which combining step an incineration of the evaporated unburned fuel takes place and thereafter leading the combined gas flow into the soot filter, and incinerating the collected soot in the soot filter.

14. A method according to claim 13, including the step of feeding at least second partial exhaust gas flow into the hot gas in the combustion chamber.

15. A method according to claim 14, including the step of successively feeding at least one further partial exhaust gas flow in addition to the second partial exhaust flow to the combustion chamber.

16. A method according to claim 13, including the step of heating the at least second partial exhaust flow by the hot gas before feeding it into the hot gas.

* * * * *